US005924435A

United States Patent [19]

Wall et al.

[11] Patent Number: 5,924,435

[45] Date of Patent: Jul. 20, 1999

[54] METHOD OF ENERGIZING AN ELECTROMAGNETICALLY OPERABLE CONTROL VALVE, AND FUEL SYSTEM INCORPORATING SAME

[75] Inventors: Robin Christopher Wall, Rochester; Brian William Tumber, Maidstone, both of United Kingdom

[73] Assignee: Lucas Industries public limited company, West Midlands, United Kingdom

[21] Appl. No.: 08/555,766

[22] Filed: Nov. 9, 1995

[30] Foreign Application Priority Data

Nov. 11, 1994 [GB] United Kingdom ..... 9422742

[51] Int. Cl.[6] ..... F16K 31/02

[52] U.S. Cl. ..... 137/1; 251/129.01; 361/154

[58] Field of Search ..... 251/129.01, 129.15, 251/129.05; 335/277, 271, 257; 123/506; 137/1; 361/154, 152, 160

[56] References Cited

U.S. PATENT DOCUMENTS 4,520,420 5/1985 Hiromi et al. .
4,726,389 2/1988 Minoura et al. ..... 251/129.05 X
4,922,878 5/1990 Shinogle et al. .
5,277,163 1/1994 Ohishi ..... 123/506 X
5,551,480 9/1996 Tomatsu et al. ..... 251/129.05 X

FOREIGN PATENT DOCUMENTS 0366622 5/1990 European Pat. Off. .
0376493 7/1990 European Pat. Off. .
2025183 1/1980 United Kingdom .
2279829 1/1995 United Kingdom .

*Primary Examiner*—Kevin Lee
*Attorney, Agent, or Firm*—Dvorak & Orum

[57] ABSTRACT

A method of energizing an electromagnetically operable valve which comprises a valve member movable into engagement with a seating when a winding is energized comprising connecting the winding to a DC supply to achieve a rapid rate of rise of current. The current is controlled at the peak value and is then reduced to a low value after an initial movement of the valve member. The valve member continues its movement towards the seating and the current is restored prior to engagement of the valve member with the seating to substantially eliminate bouncing of the valve member away from the seating.

7 Claims, 2 Drawing Sheets

METHOD OF ENERGIZING AN ELECTROMAGNETICALLY OPERABLE CONTROL VALVE, AND FUEL SYSTEM INCORPORATING SAME

BACKGROUND OF THE INVENTION

This invention relates to a method of energizing an electromagnetically operable seated fluid control valve of the kind comprising a valve member, a seating, an armature directly coupled to the valve member, a core member and a winding which when supplied with electric current magnetizes the core, the armature moving under the influence of the magnetic field to move the valve member into engagement with the seating.

Such a valve can form part of a fuel system of an internal combustion engine and in particular control the duration of fuel delivery to the engine. As such it is required to operate quickly and reliably over the service life of the engine. It has been proposed to use a low inductance and low resistance winding and to energize the winding from a DC voltage source, the source having a voltage such that current limitation at a peak value of current is required. This arrangement enables rapid movement of the armature and valve member to be achieved. However, even though the combined mass of the valve member and armature is kept as low as possible, rebound can occur when the valve member engages the seating. Moreover, the high impact velocity of the valve member and the seating results in mechanical wear leading to a deterioration in the operating characteristics of the combination over the service life.

SUMMARY OF THE INVENTION

The object of the invention is to provide a method of energizing a control valve of the kind specified in a simple and convenient form.

According to the invention a method of energizing a control valve of the kind specified comprises connecting the winding to a source of DC supply to achieve a rapid rate of rise of current, controlling the current at a peak value, reducing the current flow to a low value or zero after an initial movement of the valve member towards the seating, allowing the inertia of the armature and valve member to continue the movement of the valve member towards the seating and restoring the current flow prior to engagement of the valve member with the seating.

DETAILED DESCRIPTION OF THE INVENTION

Figure 1:
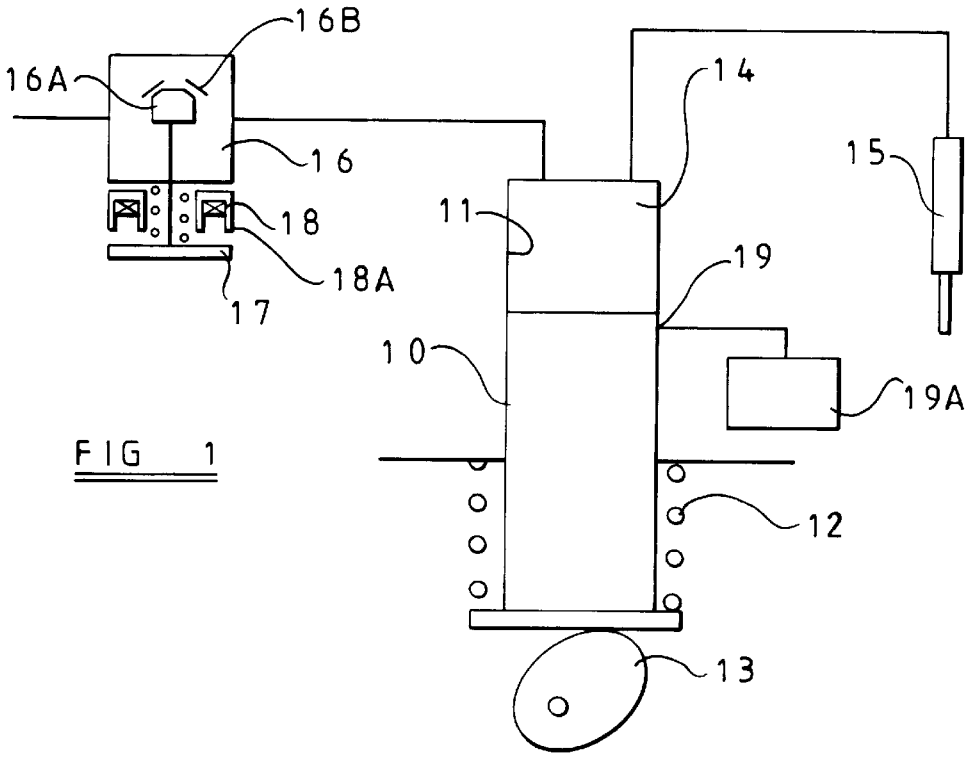
FIG. 1 shows in diagrammatic form one part of a fuel system for an internal combustion engine.

With reference to FIG. 1 the part of the system shown therein is repeated for each engine cylinder. The part of the system comprises a high pressure fuel pump including a reciprocable plunger 10 housed within a bore 11. The plunger is movable inwardly by the action of an engine driven cam 13 and outwardly by a compression spring 12.

The inner end of the bore together with the plunger form a pumping chamber 14 which has an outlet connected to a fuel pressure actuated fuel injection nozzle 15 mounted to direct fuel into an engine combustion space.

Also communicating with the pumping chamber is a spill valve 16 having a valve member 1 6A which is spring loaded to the open position. The valve member is coupled to an armature 17 which when a winding 18 carried on a core 18A is supplied with electric current, moves under the influence of the resulting magnetic field to move the valve member into engagement with a seating 16B thereby to close the spill valve. Fuel is supplied to the bore 11 through a port 19 connected to a low pressure fuel supply 19A, when the plunger has moved outwardly a sufficient amount to uncover the port 19.

Assuming that the plunger has just started its inward movement so that the port 19 is closed, fuel will be displaced from the pumping chamber 14 and will flow to a drain through the open spill valve 16. If the spill valve is now closed by energizing the winding 18, the fuel in the pumping chamber will be pressurized and when the pressure is sufficient, will open the injection nozzle 15 to allow fuel to flow into the combustion chamber. The fuel flow to the combustion chamber will continue for so long as the spill valve is closed and the pumping plunger is moving inwardly. When the winding is de-energized the spill valve will open and the flow of fuel to the engine will cease. The cycle is then repeated each time fuel is to be supplied to the respective engine cylinder.

It will be appreciated that the amount of fuel supplied to the engine depends upon the time considered in terms of degrees of rotation of the engine camshaft, during which the spill valve is closed. In real time therefore and neglecting hydraulic effects, the period of spill valve closure reduces as the engine speed increases for a given quantity of fuel supplied to the engine.

In another example of a fuel system a pair of plungers is mounted in a bore formed within a rotary cylindrical distributor member. The portion of the bore between the plungers forms the pumping chamber and the plungers are moved inwardly to displace fuel from the pumping chamber by the action of cam lobes formed on the internal surface of a cam ring. The pumping chamber communicates with a delivery passage formed in the distributor member and which communicates in turn during successive inward movement of the pumping plungers with outlet ports formed in a body in which the distributor member is located. The spill valve is in communication with the pumping chamber and in this case the spill valve is closed prior to inward movement of the plungers taking place. The timing of fuel delivery depends upon the angular setting of the cam ring which is adjustable. The spill valve is opened to spill fuel and thereby terminate delivery of fuel through an outlet to the associated engine. In this case the spill valve is operated each time fuel is delivered to the engine.

Figure 2:
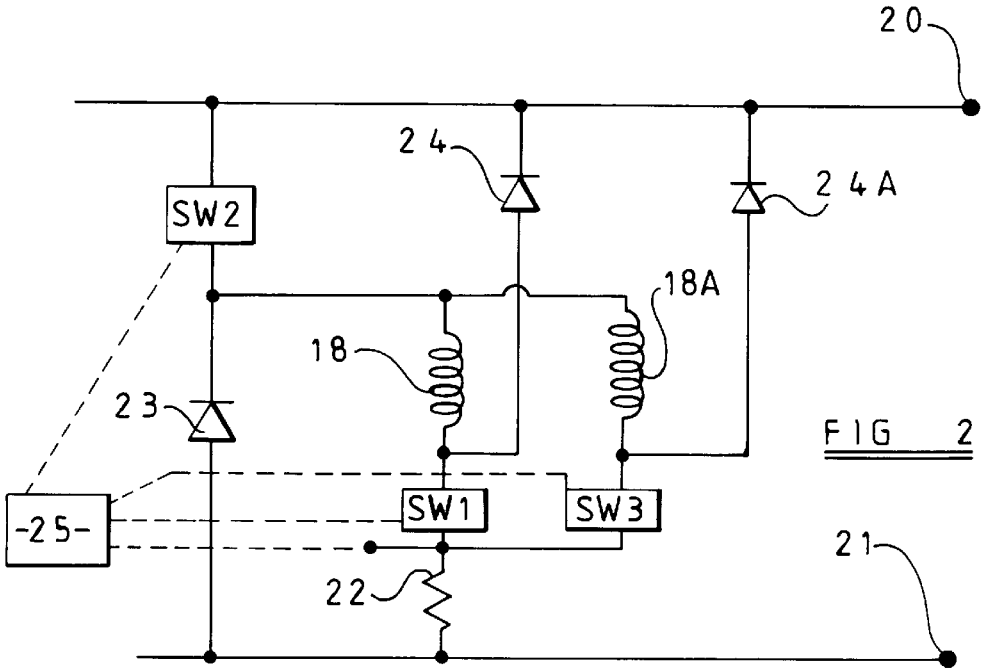
FIG. 2 shows a diagram for a drive circuit which controls the flow of electric current in a winding forming part of the fuel system of FIG. 1.

FIG. 2 shows an example of a drive circuit for the winding 18. The circuit includes first and second terminals 20, 21 for connection to the positive and negative terminals respectively of a DC supply. One end of the winding 18 is connected to terminal 20 by way of a first switch SW2 and the other end of the winding is connected by way of the series combination of a second switch SW1 and a resistor 22, to the terminal 21. The one end of the winding 18 is connected to the cathode of a diode 23 the anode of which is connected to the terminal 21 and the other end of the winding is connected to the anode of a diode 24 the cathode of which is connected to the terminal 20. The switches SW1 and SW2 are constituted by switching transistors and these are controlled by a control circuit 25. The control circuit is also supplied with the voltage developed across the resistor 22 this being representative of the current flowing in the resistor and the winding 18 during the periods of closure of switch SW1.

FIG. 2 also shows an additional winding 18A which is associated with a second spill valve of another section of the fuel system. The one end of the winding 18A is connected through switch SW2 and diode 23 to the terminals 20, 21 respectively and the other end of the winding 18A is connected to the anode of a diode 24A the cathode of which is connected to terminal 20. In addition the other end of the winding is connected by a switch SW3 to the junction of the switch SW1 and the resistor 22.

The inductance and resistance of the winding are low and the DC supply voltage is such as to necessitate current limitation. This is achieved by the usual chopping action.

The conventional routine for effecting closure of a valve is to turn both switches on so that the current increases at a high rate and then to turn one of the switches on and off when the peak value of the current is reached. After a predetermined period both switches are opened and the current in the winding is allowed to fall to a so called holding value. When it is required to open the valve both switches are opened and current allowed to fall to zero. The armature and the valve member start to move slightly before the current attains its peak value and the valve member engages the seating whilst the peak value of the current is maintained or shortly after the current starts to fall to the hold value. However, due to the bounce of the valve member the latter may not be held in firm engagement with the seating until the hold value of the current is established.

In accordance with the invention it is proposed to maintain the peak value of current for a shorter period of time during which the armature and valve member may have completed only say 20% of their travel towards the seat. The current is then reduced to zero or a low value, conveniently by an initial reduction of the current at a high rate and then at a lower rate. The armature and valve member continue their movement towards the seat under the action of their inertia. Before engagement of the valve member with the seat the current flow is restored by turning the switch on. The ensuing rise in current results in a magnetic force which supplements the inertia, and the valve member is moved into engagement with the seat. The approach velocity is however lower in this case and bounce is substantially eliminated and the impact forces reduced.

Considering now the operation of the power circuit to achieve the above result. On receipt of control pulse switches SW1 and SW2 are turned on and the current flow in the winding 18 rises at a high rate to a predetermined peak value PK. The control circuit 25 is supplied with the voltage signal developed across the resistor 22 and when the peak value of current is detected switch SW2 is turned on and off to provide a chopping action so that the current fluctuates about the peak value. Both switches are then opened for a short period during which the current decays at a high rate with energy being returned to the supply by way of diodes 23 and 24. Switch SW1 is then closed and the current decays at a lower rate, the current flowing by way of the switch, the resistor 22 and the diode 23 in series. The current is allowed to fall to zero. Before the valve member engages with the seating switch SW2 is closed and the current increases at a high rate. The current may be allowed to rise to the aforesaid peak value before switch SW2 is again switched on and off to provide the chopping action. What is more likely in practice however is that the current will be allowed to rise to a lower holding value which will hold the valve member in engagement with the seating.

When it is required to open the valve both switches are opened to allow current decay at a high rate thereby to achieve as rapid a movement as possible of the valve to the open position. The process is then repeated for winding 18A in using switches SW2 and SW3.

Figure 3:
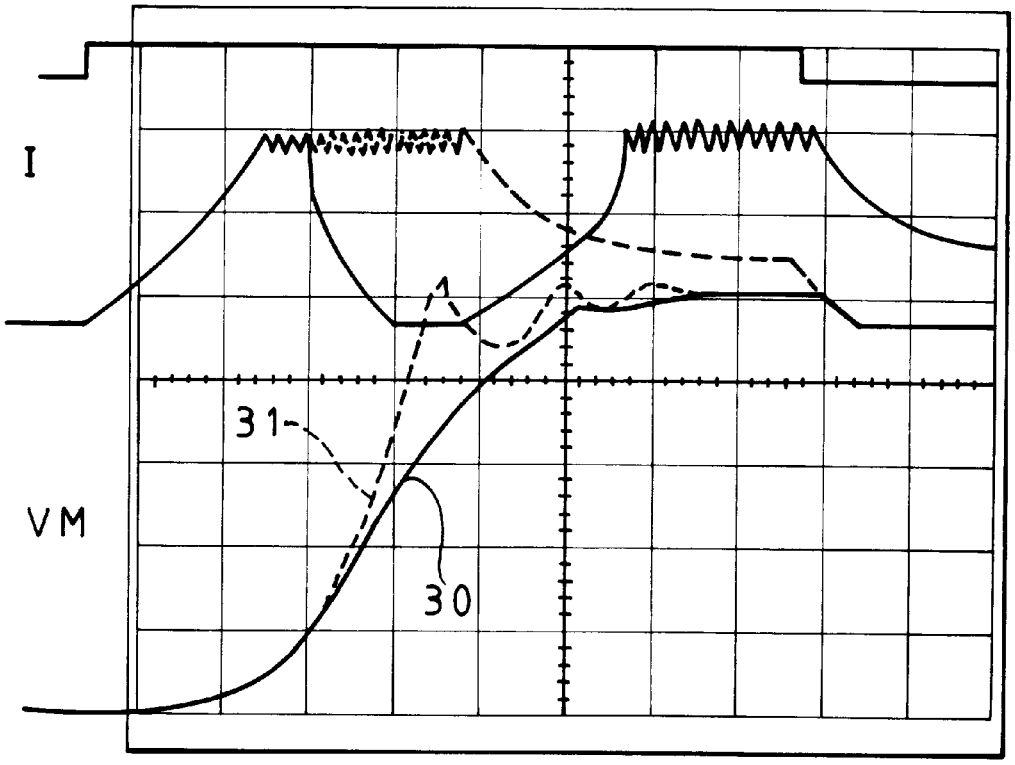
FIG. 3 shows the waveform of the current flow in the winding and the movement of the associated armature.

FIG. 3 shows the current I profile and the valve movement VM pattern. The heavy line show the proposed energization routine and the dotted line the known routine. It will be seen that the valve movement curve 30 is much less steep than the curve 31 as the valve member completes its movement and that the bounce is substantially eliminated. However, the point of complete valve closure that is to say when the valve member is held on its seat is substantially the same and may in fact occur after a slightly shorter period of time. As stated above the current when it is restored, is allowed to reach the peak value.

What is claimed is:

1. A method of energizing an electromagnetically operable seated control valve which comprises a valve member, a valve seat, an armature directly coupled to the valve member, a core member and a winding, which when supplied with an electric current magnetizes the core member, thereby generating a magnetic field, wherein the armature moves under the influence of the magnetic field to move the valve member into engagement with the valve seat, the method comprising the steps of:

connecting the winding to a DC current supply to achieve a rapid rate of rise of current;

controlling and temporarily sustaining the current at a peak valve, then reducing the current to a value lower than said peak valve after an initial movement of the valve member towards the valve seat;

allowing an inertia of the armature and the valve member to continue the movement of the valve member towards the valve seat; and restoring the current prior to engagement of the valve member with the valve seat to said peak value in order to eliminate bouncing of the valve member away from the valve seat.

2. The method according to claim 1, in which the current is controlled at the peak value until the valve member and armature have moved through about 20% of of a total extent of travel.

3. The method according to claim 1, in which the reduction of current is a two-step process, occurring initially at a high rate and then at a low rate.

4. The method according to claim 3, in which the current is maintained at the peak value by a saw tooth shaped current flow.

5. The method according to claim 1, in which the current is restored to the peak value prior to engagement of the valve member with the seating.

6. The method according to claim 1, in which the current is restored to a holding value prior to engagement of the valve member with the seating, said holding value of current being sufficient to maintain the valve member in engagement with the seating.

7. In a fuel system for an internal combustion engine having a cam actuated plunger movable in a bore under action of an engine driven cam, a spill control valve communicating with the bore, the valve comprising a valve member seatable in a valve seat, said valve member movable by an electrical coil winding associated with said valve member, said coil winding energized by an electrical current, which said current is controlled by a control circuit, said valve member moved into engagement with said valve seat when said electrical coil winding is supplied with said electric current, said control circuit operably connecting the coil winding to a DC power source to achieve a rapid rate of rise of current in the coil winding, and to control and temporarily sustain the current at a peak value until after an initial movement of the valve member towards the valve seat, wherein the control circuit substantially reduces the current, whereby the valve member continues to move towards the valve seat due to inertia, the control circuit adapted to restore the current flow to said peak value prior to the valve member engaging the valve seat in order to eliminate bounce of the valve member away from the seat.

* * * * *